US011959158B2

(12) United States Patent
Huang et al.

(10) Patent No.: US 11,959,158 B2
(45) Date of Patent: *Apr. 16, 2024

(54) HOT-WORK DIE STEEL WITH HIGH TOUGHNESS AT LOW TEMPERATURES AND HIGH STRENGTH AT HIGH TEMPERATURES AND HIGH HARDENABILITY AND PREPARATION METHOD THEREOF

(71) Applicant: University of Science & Technology Beijing, Beijing (CN)

(72) Inventors: Jinfeng Huang, Beijing (CN); Jin Zhang, Beijing (CN); Chao Zhao, Beijing (CN); Cheng Zhang, Beijing (CN)

(73) Assignee: University of Science & Technology Beijing, Beijing (CN)

( * ) Notice: Subject to any disclaimer, the term of this patent is extended or adjusted under 35 U.S.C. 154(b) by 122 days.

This patent is subject to a terminal disclaimer.

(21) Appl. No.: 17/501,193

(22) Filed: Oct. 14, 2021

(65) Prior Publication Data

US 2022/0090243 A1 Mar. 24, 2022

Related U.S. Application Data

(63) Continuation of application No. PCT/CN2020/091212, filed on May 20, 2020.

(30) Foreign Application Priority Data

Apr. 14, 2020 (CN) ..... 202010288511.3

(51) Int. Cl.
*C22C 38/46* (2006.01)
*C21D 1/18* (2006.01)
(Continued)

(52) U.S. Cl.
CPC ..... *C22C 38/46* (2013.01); *C21D 1/18* (2013.01); *C21D 1/26* (2013.01); *C22C 38/002* (2013.01);
(Continued)

(58) Field of Classification Search
CPC .... B21D 37/10; B22C 9/061; B22D 17/2209; B22D 23/10; C21D 1/19; C21D 1/25;
(Continued)

(56) References Cited

U.S. PATENT DOCUMENTS 4,171,233 A * 10/1979 Vander Voort ..... C22C 38/40 148/330
5,919,578 A * 7/1999 Lundell ..... C22C 38/44 228/114.5
11,180,820 B1 * 11/2021 Huang ..... C21D 6/005

FOREIGN PATENT DOCUMENTS

AU 2003258841 B2 * 5/2008 ..... B22D 17/2209
CN 1405353 A 3/2003
(Continued)

OTHER PUBLICATIONS

NPL: On-line translation of CN 109355653 A, Feb. 2019 (Year: 2019).*
(Continued)

*Primary Examiner* — Jie Yang
(74) *Attorney, Agent, or Firm* — Wood Herron & Evans LLP

(57) ABSTRACT

A low-carbon and low alloy hot-work die steel with a high toughness at low temperatures and a high strength at high temperatures and a high hardenability, comprises the following components: C: 0.15-0.35%, Si: 0.40-0.90%, Mn: ≤0.80%, Cr: 1.50-2.40%, Ni: 2.50-4.50%, Mo: 1.00-1.60%, V: 0.10-0.40%, W: 0.20-0.90%, P: ≤0.02%, S≤0.02%, and a balance of Fe matrix and other inevitable impurities. The
(Continued)

above percentages are mass percentages. The material of the present invention can have a V notch impact energy of 30 J or more than 30 J at −40° C., a high temperature strength of 380 MPa or more at 700° C., and a hardenability of 200 mm or more to ensure the consistency of internal and external microstructures. The materials of the present invention can be applied to hot-work molds used in special working conditions that require high toughness at low temperatures, high strength at high temperatures and high hardenability.

9 Claims, 1 Drawing Sheet

(51) Int. Cl.

| | |
|---|---|
| ***C21D 1/26*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C22C 38/005* (2013.01); *C22C 38/02* (2013.01); *C22C 38/04* (2013.01); *C22C 38/44* (2013.01); *C22C 38/48* (2013.01); *C22C 38/50* (2013.01); *C22C 38/52* (2013.01); *C22C 38/54* (2013.01)

(58) Field of Classification Search
CPC .... C21D 1/26; C21D 1/28; C22B 9/18; C22C 1/02; C22C 38/04; C22C 38/44; C22C 38/46
USPC ..... 420/109
See application file for complete search history.

(56) References Cited

FOREIGN PATENT DOCUMENTS

| | | | |
|---|---|---|---|
| CN | 102165086 | A | 8/2011 |
| CN | 106086688 | A | 11/2016 |
| CN | 106222543 | A | 12/2016 |
| CN | 106435353 | A | 2/2017 |
| CN | 109355653 | A | 2/2019 |
| CN | 109487166 | A | 3/2019 |
| CN | 109735777 | A | 5/2019 |
| CN | 110438310 | A | 11/2019 |
| CN | 111500928 | A | 8/2020 |
| JP | 2002371341 | A | 12/2002 |
| SU | 889735 | A1 | 12/1981 |

OTHER PUBLICATIONS

NPL-1: Hardness Conversion Table, http://www.gordonengland.co.uk/hardness/hardness_conversion_2m.htm (down-load on 2007) (Year: 2007).*

* cited by examiner

HOT-WORK DIE STEEL WITH HIGH TOUGHNESS AT LOW TEMPERATURES AND HIGH STRENGTH AT HIGH TEMPERATURES AND HIGH HARDENABILITY AND PREPARATION METHOD THEREOF

FIELD OF THE INVENTION

The present invention belongs to the technical field of die steel, especially to a hot-work die steel with high toughness at low temperatures and high strength at high temperatures and high hardenability and preparation method thereof.

BACKGROUND OF THE INVENTION

Hot-work die steel is mainly used in thermoforming molds, hot extrusion molds and die casting molds. In addition to the high temperature and high load under the actual operating conditions, these molds are also subjected to the temperature change of the rapid cooling and heating. Therefore, heat fatigue cracks are easily induced, and the thermal fatigue resistance directly affects the service life of hot-work die steel [1]. Studies in literatures have shown that increasing the strength and toughness of materials at high temperature can increase the fatigue resistance and thus prolongs the fatigue life of materials [2]. This is because the high strength can reduce the plastic strain amplitude in each thermal cycle, and higher toughness can relax the local stress concentration. Further studies suggest that high strength can delay the initiation of fatigue cracks of die steel, and high plasticity and toughness can delay the propagation of thermal fatigue cracks [3]. Moreover, the temperature in many areas can be as low as −40° C. in winter and it is necessary to improve the toughness of the material at low temperature such as −40° C. to ensure the die material is safer in service. In addition, the products of many large-scale hot-work molds have large size, so that the hot-work die steel needs a high hardenability to ensure the consistency of internal and external microstructure properties. In summary, in order to prolong the service life of the hot-work die steel, the following new requirements are proposed: an increased high temperature strength of 350 MPa at 700° C., a V notch impact energy of 30 J or more than 30 J at −40° C., and a hardenability comparable with that of the traditional hot-work die steels.

Traditional hot-work die steels are mainly divided into three categories: high alloy hot-work die steels, medium alloy hot-work die steels and low alloy hot-work die steels. According to the document [4], an high alloy hot-work die steel 3Cr2W8V has a high temperature tensile strength of 415 MPa at 700° C.; a medium alloy hot-work die steel H13 has a high temperature tensile strength of 292 MPa at 700° C.; a low alloy hot-work die steel 5CrMnMoSiV has a high temperature tensile strength of 137 MPa at 700° C. The impact toughness of the 3Cr2W8V and H13 are 13 J and 21 J at room temperature, respectively, and the steel 5CrMnMoSiV has an impact toughness of 34.7 J at room temperature. Therefore, the impact toughness of the three materials at low temperature of −40° C. will be lower than that of at room temperature, which is generally only ½ to ⅓ of the impact toughness at room temperature. In conclusion, the existing hot-work die steels cannot meet the requirements of high toughness at low temperatures and high strength at high temperatures.

With the development of the economy and industry, the service conditions of molds are increasingly harsh. At the same time, in order to ensure the safety use of the hot-work die steel in extremely cold areas, the high temperature strength, low temperature toughness and hardenability of the hot-work die steel are further required in modern manufacturing industries. Therefore, it is necessary to develop a hot-work die steel with high toughness at low temperatures and high strength at high temperatures and high hardenability.

Document 1: Pengcheng XIA, Yunbo CHEN, Xueyuan G E et al., Research Status and Development Trends of Thermal Fatigue Property of Hot Die Steels [J]. Heat Treatment of Metals. 2008(12): 1-6.

Document 2: Xiaozeng FENG, Jianhong LIU, The Difference of the Thermal Fatigue Mechanism and Resistance between 3Cr2W8V and 4Cr5MoSiVl [J]. Journal of Anhui Institute of Technology. 1988(2): 1-9.

Document 3: Jianhong LIU, Study on Thermal Fatigue Mechanism of Hot Work Die Steel 3Cr2W8V4Cr5MoSiV1 [D]. 1987.

Document 4: Zongyuan ZHU, Property data set of hot work die steel in China (continued II) [J]. Materials for Mechanical Engineering, 2001(3).

SUMMARY OF THE INVENTION

Technical Problems to be Solved

Focusing on the shortcomings of the prior art such as the safety problem of hot-work die steel at low temperature, the present invention provides a hot-work die steel with high toughness at low temperatures and high strength at high temperatures and high hardenability according to the principle of multivariate compound strengthening. The hot-work die steel has the advantages of high toughness at low temperatures, high strength at high temperatures and high hardenability, by utilizing the microstructure controlling technique of the design and preparation of low carbon and medium and low alloy components.

Technical Solutions for Solving the Technical Problems

In view of the above problems, the present invention provides a low-carbon and low alloy hot-work die steel with high toughness at low temperatures and high strength at high temperatures and high hardenability, comprising the following components: C: 0.15-0.35%, Si: 0.40-0.90%, Mn: ≤0.80%, Cr: 1.50-2.40%, Ni: 2.50-4.50%, Mo: 1.00-1.60%, V: 0.10-0.40%, W: 0.20-0.90%, P: ≤0.02%, S≤0.02%, a balance of Fe matrix and other inevitable impurities. The above percentages are all mass percentages.

In one embodiment of the invention, in addition to the main components above, the hot-work die steel comprises 0.01-0.03% Zr, 0.10-0.50% Co, 0.001-0.005% B, 0.01-0.05% Nb or 0.01-0.10% Re by mass.

According to another aspect of the invention, the invention provides a method for preparing the hot-work die steel, comprising: i) smelting process; ii) homogenizing annealing and forging process; iii) post-forging annealing process; and iv) quenching and tempering process.

In one embodiment of the invention, in the smelting process, smelting is performed through a process of electric arc furnace smelting, ladle furnace refining process, vacuum degassing (EAF+LF+VD) and electroslag remelting process (ESR). Besides, in the smelting process, the mass percentage of each component is as that of each component in claim 1 or 2.

In one embodiment of the invention, in the smelting process, a rare earth should be replenished to maintain its mass content to be more than or equal to 0.01% in the ESR process.

In one embodiment of the invention, in the homogenizing annealing and forging process, an ingot from step i) is heated to 1200-1250° C. for 5 hours or more, held for 15-25 hours, subsequently cooled down to a heating temperature of 1130-1200° C., and then held for 2-3 hours. In a blooming forging process, an initial forging temperature is 1050-1130° C., a final forging temperature is 850° C. or more, an upsetting and drawing is repeated for 1 to 3 times, and an upsetting ratio is greater than 2.

In one embodiment of the invention, in the homogenizing annealing and forging process, GFM precision forging or other forging means for molding is performed according to the demand. For precision forging, a heating temperature is 900-1050° C., an initial forging temperature is 850-950° C., and a final forging temperature is 800° C. or more; for forging by hydraulic hammer or hydraulic press, a heating temperature is 1150-1200° C., an initial forging temperature is 1130-1160° C., and a final forging temperature is 850° C. or more.

In one embodiment of the invention, in the post-forging annealing process, an obtained forged component from step ii) is transferred to a furnace immediately, and heated to 850-900° C. at a heating rate of 100° C./h or less, held for 6-8 hours, cooled to 500° C. or less in the furnace, removed from the furnace, and cooled in heap to obtain a preform.

In one embodiment of the invention, in the quenching and tempering process, the preform from step iii) is quenched and tempered, wherein the preform is heated to 920-980° C. and held for 1-6 hours, and then cooled to approximately 50-150° C. with water or oil during quenching process, then tempered immediately.

In one embodiment of the invention, the tempering process can be carried out twice, wherein a temper temperature is chosen according to the mechanical properties required by the final product, the performance parameters are tested, and a temperature and duration of a second tempering are determined with test results of performance parameters.

Beneficial Effects of the Invention

The materials of the present invention with low-carbon and low alloy components show a high temperature strength comparable with that of medium-carbon and high-carbon hot-work die steels, a low temperature toughness at −40° C. comparable with that of low-carbon hot-work die steels and outstanding hardenability compared to the existing hot-work die steels.

Further characteristics of the invention will become apparent from the following description of exemplary embodiments.

BRIEF DESCRIPTION OF THE DRAWINGS

FIG. 1A: microstructure morphology; FIG. 1B: morphology of carbides; FIG. 1C: diffraction patterns of carbides; and FIG. 1D: high resolution morphology of carbides.

DETAILED DESCRIPTION OF THE INVENTION

Figure 1A:
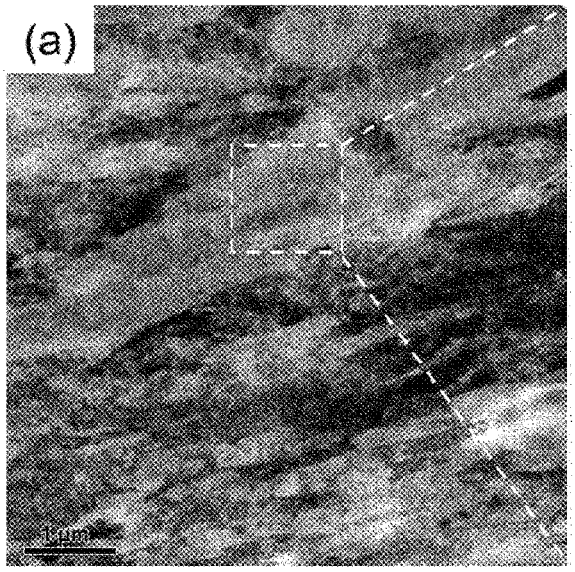
FIGS. 1A-1D provides the microstructure morphology and carbide analysis of the steel of the invention in quenching and tempering condition.

In the following, a specific embodiment illustrating the present disclosure is described. However, the present invention shall not be limited by the specific embodiment described herein.

The concept of the present application is as follows:

1. The composition design of the invention adopts the chemical components with low-carbon and low alloying elements, wherein the alloying elements, e.g., but not limited to, Cr, Mo, W and V, form disperse carbides with the element carbon (C). The high temperature strength of the materials can be enhanced by the forming of alloy carbides and the good orientation relationship of the alloy carbides with the matrix thereof, and the strength depends on the joint strengthening of W/Mo. Specific high temperature strength of the materials of the invention are provided in Table 2.

2. Because of the low carbon content and high Ni content of the materials of the invention, the microstructures after quenching and tempering are lath martensites rather than acicular martensites, which therefore lead to the high toughness of the materials of the invention at low temperatures. Rare earths, alloying elements such as Mn, Si, etc. are further added to improve the purity of the materials of the invention, to improve the toughness of the materials of the invention. Specific low temperature toughness of the materials of the invention at −40° C. are provided in Table 3.

3. The hardenability of the materials of the invention may be significantly improved by involving moderate amount of alloying elements such as, but not limited to, W, Mo, Ni, Cr and Mn. Specific hardenability of the materials of the invention are provided in Table 4.

The function of each constituent element of the steel of the present invention and the selection of the content range are further described below. In the following description, the added amounts of the elements are expressed by mass ratio (%):

C: Carbon is the most fundamental element in steel, determining the hardness and strength of the martensite after quenching. The quenched microstructure of low-carbon steel, dislocation martensite, shows not only a high toughness, but also a certain plastic deformation capacity, which may reduce the formation of quenching cracks. Low carbon content may lead to poor hardenability and insufficient strength, so that the carbon content should be controlled to more than 0.15%. However, acicular martensites may be formed after quenching process when the carbon content is over 0.35%, which may lead to high stress and reduce the low temperature toughness of the materials. Therefore, the carbon content is designed to be in the range of 0.15% to 0.35%.

Ni: Nickel can improve the hardenability and the low temperature toughness of steel, and may improve the hardenability of steel in combination with Cr, W and Mo, so as to ensure that large-section steel can obtain better strength and ductility after quenching and tempering treatment. The low temperature toughness of the materials at −40° C. would be insufficient when the Ni content is below 2.5%. However, the addition of more than 4.5% Ni will lead to carbide precipitation along austenite grain boundary during quenching, which has a negative effect on the corrosion resistance of the steel. Therefore, the nickel content is designed to be in the range of 2.50% to 4.50%.

Cr: Chromium is a medium carbide forming element. Chromium carbide is the smallest one among all kinds of carbides, which can be evenly distributed in the matrix of steel, so it has high strength, hardness, yield point and high abrasion resistance. Cr content of over 2.4% may have adverse effects on the toughness and precipitated phase, particularly the low temperature toughness. Nevertheless, when the Cr content is lower than 1.5%, the corrosion resistance and oxidation resistance of the material will be affected, so the Cr content in the steel of the invention is in the range of 1.50% to 2.40%.

Mo: Molybdenum has a good effect on grain refinement, and may increase the strength of steel without decreasing the plasticity, improve the impact toughness of steel, and significantly improve the hardenability of steel in combination with Cr and/or Ni. However, the grain size may be larger when the Mo content is lower than 1.0%. In case that the Mo content is higher than 1.6%, 6-ferrite phase or other brittle phases are easily appeared, making the low temperature toughness to be less than 30 J at −40° C. Therefore, the Mo content is designed to be in the range of 1.00% to 1.60%.

V: Vanadium is a strong carbide forming element, which can improve the stability of the carbide thereof, effectively prevent the growth of austenite grains, make the steel form a refined martensite microstructure after quenching, and improve the temper toughness of steel. Studies have shown that a V content exceeding 1% will have an adverse effect on toughness, while an excessive V content is detrimental to hardenability, which may lead to a depth of the quenching layer in an end quenching test of less than 200 mm. Thus, the range of V content is designed as 0.10% to 0.40% in order to ensure the toughness and hardenability of the materials of the invention.

W: Tungsten can not only improve the hardenability of the materials, but also improve the thermal strength, thermal stability and high temperature strength of the steel. The first way is to improve the red hardness of the steel matrix by solid solution, and the second way is to form special carbides (M2C, MC) for secondary hardening. Tungsten can improve the thermal stability of steel in combination with molybdenum, as Mo is an alloying element that is easy to be oxidized, while the addition of tungsten may inhibit the oxidation and volatilization of Mo. However, in case that the tungsten content is more than 1.0%, there will be no significant improvement on the thermal strength, and the low temperature toughness of steel will be reduced. Therefore, the W content in the steels of the invention are controlled to be in the range of 0.20% to 0.90%.

Zr: Zirconium is a powerful deoxidizing and denitrifying element in the steelmaking process. A small amount of Zr added can combine with oxygen and nitrogen during the smelting process to form fine and dispersed oxides and nitrides in the matrix, which is beneficial to refine the grain structure. Besides, element Zr can also combine with the impurity element S to form sulfide so as to prevent the hot brittleness of steel. Therefore, the range of Zr content can be controlled in the range of 0.01% to 0.04% in order to obtain the steel with finer and purer microstructure.

Si: Silicon can be used as reducing agent and deoxidizer in steelmaking process, which can increase annealing, normalizing and quenching temperature, and improve hardenability in hypoeutectoid steel. Besides, silicon can significantly increase the elastic limit, yield point and tensile strength of steel. Furthermore, the carbide-free bainite structure composed of lath ferrite and residual austenite film between laths can be obtained by increasing Si content, which has high strength, high hardness and high impact toughness at low temperatures. Therefore, the Si content is in the range of 0.40% to 0.90%.

Mn: The increase of manganese content within appropriate limits can improve the strength and hardness of the steel, and has the effect of deoxidation and desulfurization. Manganese can also replace part of nickel to improve the hardenability of the materials and reduce the cost of the materials. However, an excessive Mn content will lead to poor corrosion resistance and welding performance. Therefore, the manganese content shall not exceed 0.80%.

Re: Rare earth can control the form of sulfide in steel, assist deoxidizing and desulfurizing, and improve the lateral performance and low temperature toughness of steel. In low-sulfur steel, rare earth also plays a role of dispersion hardening. Therefore, rare earth with a content of 0.01-0.03% can be introduced to deoxidize and desulfurize steel, purify molten steel and improve the strength and toughness of steel.

Co: Like nickel and manganese, cobalt can form a continuous solid solution with iron, hinder and delay the precipitation and aggregation of carbides of other alloys during the tempering process, and can significantly improve the thermal strength of the material. However, cobalt should not be added in excess as it may reduce the hardenability of martensitic steel. Therefore, it is designed to be in the range of 0.10% to 0.50%.

B: Boron has an outstanding ability to improve hardenability within a certain content range, but non with a content exceeding 0.005%. It plays a role in strengthening the grain boundary in steel and can significantly improve the high temperature strength of the material. Therefore, it is designed to be in the range of 0.001% to 0.005%.

S, P: As impurity elements, both sulfur and phosphorus have great adverse effects on the toughness of materials. Therefore, the content of S and P should be reduced, which should be controlled to be less than 0.02%.

Fe: Iron is the matrix element, and scrap and pure iron can be selected according to the specific working conditions and purity requirements.

The present invention provides key improvements in composition content and process. Composition: Forming MC-type alloy carbides under the complex action of Cr, Mo, W, V and other elements, which can maintain a coherent orientation relationship with the matrix at high temperatures, thereby making the material gaining high strength at high temperatures; applying a low-carbon, high-nickel design to form lath martensite/sorbite structure, thereby making the material gaining high toughness at low temperatures; adding rare earth, Mn, Si and/or other alloying elements to improve the purity of the material, which can further improve the toughness of the material; involving an appropriate amount of W, Mo, Ni, Cr, Mn and other elements to ensure hardenability of the material. Process: according to the characteristics of large-size steel ingot in the invention, the post-forging annealing process and the quenching and tempering process (temperature, time) are adjusted to obtain the steel with best performance.

Through the above key improvements, the existing difficulties in the prior art that hot-work die steel cannot possess the property of both high impact toughness at low temperatures and high strength at high temperatures is solved. Besides, the hardenability of the inventive hot-work die steel are comparable with that of steel H13, making it being suitable for the manufacture of large-scale molds.

The present invention provides a low-carbon, low alloy, hot-work die steel with high toughness at low temperatures and high strength at high temperatures and high hardenability, and the specific preparation method comprises:

i) A Smelting Process:

The smelting process is performed through a process of electric arc furnace smelting, ladle furnace refining process, vacuum degassing (EAF+LF+VD) and electroslag remelting (ESR). The mass percentage of each component is as:

C: 0.15-0.35%, Si: 0.40-0.90%, Mn: ≤0.80%, Cr: 1.50-2.450%, Ni: 2.50-4.50%, Mo: 1.00-1.60%, V: 0.10-0.40%,

W: 0.20-0.90%, P: ≤0.02%, S≤0.02% and Fe matrix. In addition to the main components above, the hot-work die steel may further comprises 0.01-0.03% Zr, 0.10-0.50% Co, 0.001-0.005% B, 0.01-0.05% Nb and/or 0.01-0.10% Re appropriately depending on the performance requirements. A rare earth should be replenished to maintain its mass content to be more than or equal to 0.01% in the electroslag remelting process since the rare earth is volatile during this process.

ii) A Homogenizing Annealing and Forging Process:

An ingot from step i) is heated to 1200-1250° C. for 5 hours or more, held for 15-25 hours, subsequently cooled down to the heating temperature of 1130-1200° C., and then held for 2-3 hours. The obtained ingot is forged and drawn by an oil hydraulic press, during which the initial forging temperature is 1050-1130° C., the final forging temperature is 850° C. or more, the upsetting and drawing is repeated for 1 to 3 times, and the upsetting ratio is greater than 2. GFM precision forging or other forging forms may be used therewith for molding according to the demand. For precision forging, the heating temperature is 900-1050° C., the initial forging temperature is 850-950° C., and the final forging temperature is 800° C. or more; for forging by hydraulic hammer or hydraulic press, the heating temperature is 1150-1200° C., the initial forging temperature is 1130-1160° C., and the final forging temperature is 850° C. or more.

iii) A Post-Forging Annealing Process:

The obtained precision forged ingot from step ii) is transferred to a furnace immediately, and heated to 850-870° C. at a heating rate of 100° C./h or less, held for 6-8 hours, cooled to 500° C. or less in the furnace, removed from the furnace, and cooled in heap.

iv) A Quenching and Tempering Process:

The obtained prefabricated ingot from step iii) are quenched and tempered, wherein the ingot are heated to 920-980° C. and held for 1-6 hours, and then cooled to approximately 50-150° C. with water or oil during quenching process, then tempered for once or twice immediately. The temper temperature and duration is chosen according to the mechanical properties required by the final product, e.g., but not limited to, 580° C. for 4-10 hours. The performance parameters are tested, and a temperature and duration of a second tempering are determined with the test results of performance parameters of hardness, toughness, etc.

Example

In the following, the present invention is described in more detail by examples. However, the invention shall not be limited by the specific examples described herein. Notably, "parts" means "mass parts" unless stated otherwise.

The specific composition of alloying elements of Example 1-6 are shown in Table 1.

A method for preparing the hot-work die steel with a high toughness at low temperatures and a high strength at high temperatures and a high hardenability, comprises:

i) formulating the materials according to the chemical compositions of Examples 1-6;

ii) smelting the formulated materials in step i) by electric arc furnace smelting, ladle furnace refining process, vacuum degassing (EAF+LF+VD) and electroslag remelting (ESR) and the like;

iii) heating an electroslag ingots obtained in step ii) to 1260° C. in at least 5 hours, holding for 8 hours, followed by cooling to 1200° C. for blooming forging, wherein an initial forging temperature is 1200° C., a final forging temperature is 850° C., an upsetting and drawing is carried out for once, and an upsetting ratio is greater than 2;

iv) remelting the materials to 1160-850° C. at a heating rate of 100° C./h and holding for 1 hour after the blooming forging process, then forming by a precision forging machine with an initial forging temperature of 1160° C. and a final forging temperature of 800° C.;

v) transferring an obtained precision forged ingots from step iv) to a furnace immediately, heating to 860° C. at a heating rate of 100° C./h or less and holding for 6-8 hours, then cooling to 500° C. or less in the furnace, followed by removing from the furnace and cooling in heap; and vi) quenching and tempering an obtained prefabricated ingot from step v), heating the ingot to 930-980° C. and holding for 1 hour for quenching, and then cooling to approximately 200° C. with water or oil, followed by tempering at 520-620° C. to obtain a hardness of 45HRC after tempering.

Figure 1B:
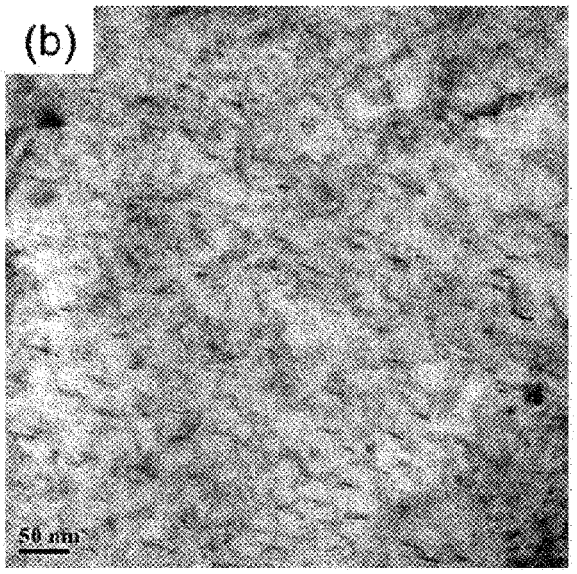
Figure 1C:
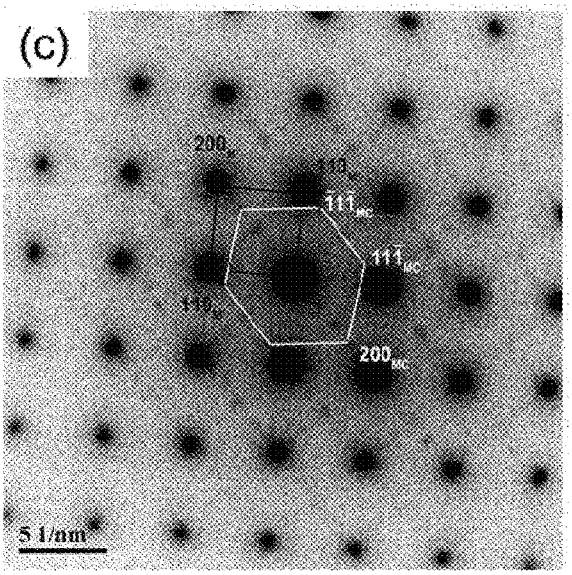
Figure 1D:
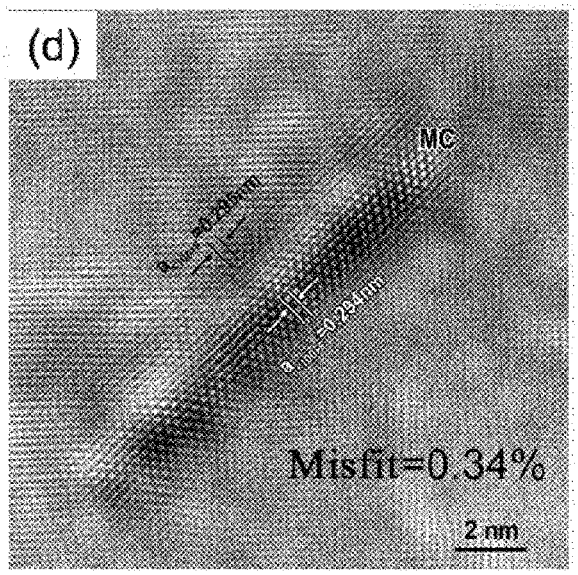

The steel of the present invention in Example 5 is quenched at 980° C. and tempered at 620° C. for 4 hours, and the microstructure and carbides morphology are shown in FIGS. 1A-1D. FIG. 1A illustrates that the microstructure are lath tempered martensite. FIG. 1B and FIG. 1C illustrate that flake MC-type carbides are dispersed between laths. As shown in the high resolution morphology in FIG. 1D, the obtained MC-type carbides have a coherent orientation relationship with the matrix, which could be maintained at high temperatures so as to obtain a steel high strength at high temperatures.

Performance test: Mechanical properties and hardenability testing were carried out on the hot-work die steel with a high toughness at low temperatures and a high strength at high temperatures and a high hardenability in Examples 1-6, as well as the materials steel H13, 5CrMnMoSiV and 3Cr2W8V in Comparative Examples 1-3 respectively. For hardenability, materials of Example 1 and Example 4 were tested in comparison with that of steel H13. Relevant test standards and specific test data are shown in Tables 3-4 below:

i) The following Examples and Comparative Examples were tested for V notch impact energy at −40° C. under Metallic materials—Impact toughness testing at lower temperature according to HB 5278-1984.

ii) The tensile strength and yield strength at 700° C. were tested under Methods of Metallic materials—Tensile testing at elevated temperature according to GB/T4338-2006. The method for tensile testing at ambient temperature is according to GB/T 228.1-2010.

iii) The Standard Test Method for Determining Hardenability of Steel is according to ASTM A255-02.

The following conclusions can be drawn from the comparison in Tables 3-4.

i) As shown in Table 3, the high temperature strength of the materials of the present invention at 700° C. are greater than that of the hot-work die steel H13 and 5CrMnMoSiV. In some examples, they are even higher than that of the high alloy hot work die steel 3Cr2W8V, indicating that the steel of the present invention has excellent high temperature strength. The impact toughness of the materials of the present invention at room temperature are higher than that of Comparative Examples 1-3. Furthermore, the impact toughness of the Examples 1-3 of the invention at −40° C. are even higher than that of the toughness of Comparative Examples 1-3 at room temperature. Since the low temperature toughness of materials are usually much lower than that of the room temperature toughness, the low temperature toughness of the materials of the present invention are much higher than that in the Comparative Examples. The room temperature tensile strength of the steel of the present invention can be adjusted in the range of 1200 MPa to 1600 MPa by adjusting the heat treatment process according to the requirements of the working conditions, while ensuring that the high temperature strength is stable substantially.

ii) As shown in Table 4, with the increase of the distance from the end quenching surface, the hardness of the materials with the upper and lower limits of components of the invention decreased to a similar degree, indicating that the hardenability of the materials of the present invention are comparable with steel H13.

TABLE 1

The content of specific components of each Example

| Element | Example 1 | Example 2 | Example 3 | Example 4 | Example 5 | Example 6 | Comparative Example 1 H13 | Comparative Example 2 5CrMnMoSiV | Comparative Example 3 3Cr2W8V |
|---|---|---|---|---|---|---|---|---|---|
| C | 0.16 | 0.33 | 0.32 | 0.28 | 0.34 | 0.32 | 0.42 | 0.49 | 0.36 |
| Si | 0.60 | 0.70 | 0.80 | 0.60 | 0.60 | 0.50 | 0.99 | 0.98 | 0.21 |
| Mn | 0.20 | 0.50 | 0.40 | 0.60 | 0.60 | 0.60 | 0.42 | 1.02 | 0.28 |
| Cr | 1.60 | 2.10 | 2.20 | 1.60 | 2.00 | 2.00 | 5.19 | 1.58 | 2.52 |
| Mo | 1.00 | 1.50 | 1.60 | 1.00 | 1.60 | 1.40 | 1.64 | 0.41 | — |
| Ni | 2.50 | 4.20 | 4.30 | 2.50 | 4.20 | 4.30 | — | — | 0.06 |
| V | 0.20 | 0.25 | 0.30 | 0.20 | 0.20 | 0.30 | 1.01 | 0.25 | 0.32 |
| W | 0.30 | 0.30 | 0.65 | 0.60 | 0.70 | 0.50 | — | — | 8.18 |
| Re | — | — | — | — | — | 0.05 | — | — | — |
| Nb | — | — | — | — | — | 0.02 | — | — | — |
| Zr | — | — | — | — | — | 0.02 | — | — | — |
| Co | — | — | — | — | — | 0.3 | — | — | — |
| B | — | — | — | — | — | 0.003 | — | — | — |
| Fe | balance | balance | balance | balance | balance | balance | balance | balance | balance |

Note:

i) The upper and lower limits of components of the materials of the present invention are investigated with comparison of Example 1 and Example 2.

ii) The influences of elements Cr, Mo and Ni of the materials of the present invention are investigated with comparison of Examples 3, 4 and 5.

ii) The influences of elements V and W of the materials of the present invention are investigated with comparison of Examples 2, 3 and 5.

iv) The influences of trace elements Re, Nb, Zr, Co and B added in the materials of the present invention are investigated with comparison of Examples 2 and 6.

TABLE 2

Heat treatment process of the steel of the present invention

| Example | Heat Treatment Process |
|---|---|
| Steel 1 of the present invention | 930° C. × 1 h water quenching, 580° C. × 4 h tempering |
| Steel 2 of the present invention | 980° C. × 1 h water quenching, 620° C. × 4 h tempering |
| Steel 3 of the present invention | 970° C. × 1 h water quenching, 620° C. × 4 h tempering |
| Steel 4 of the present invention | 950° C. × 1 h water quenching, 600° C. × 4 h tempering |
| Steel 5 of the present invention | 980° C. × 1 h water quenching, 520° C. × 4 h tempering |
| Steel 6 of the present invention | 980° C. × 1 h water quenching, 600° C. × 4 h tempering |
| Comparative Example 1 H13 | 1050° C. × 1 h water quenching, 620° C. × 4 h tempering |
| Comparative Example 2 5CrMnMoSiV | 1130° C. × 1 h water quenching, 610° C. × 4 h tempering |
| Comparative Example 3 3Cr2W8V | 880° C. × 1 h water quenching, 630° C. × 4 h tempering |

TABLE 3

The high temperature tensile strength and low temperature impact energy of each Example and Comparative Example

| Material | Tensile strength, 700° C. $R_m$/MPa | Tensile strength, 700° C. $R_{p0.2}$/MPa | Impact energy, −40° C. $A_{kV}$/J | Impact energy, room temperature $A_{kV}$/J |
|---|---|---|---|---|
| Example 1 | 380 | 278 | 42 | 58 |
| Example 2 | 435 | 316 | 39 | 51 |

TABLE 3-continued

The high temperature tensile strength and low temperature impact energy of each Example and Comparative Example

| Material | Tensile strength, 700° C. $R_m$/MPa | Tensile strength, 700° C. $R_{p0.2}$/MPa | Impact energy, −40° C. $A_{kV}$/J | Impact energy, room temperature $A_{kV}$/J |
|---|---|---|---|---|
| Example 3 | 415 | 302 | 36 | 50 |
| Example 4 | 400 | 295 | 34 | 46 |
| Example 5 | 455 | 328 | 28 | 37 |
| Example 6 | 418 | 309 | 32 | 43 |
| Comparative Example 1 H13 | 292 | 255 | — | 21 |
| Comparative Example 2 5CrMnMoSiV | 137 | 102 | — | 34.7 |
| Comparative Example 3 3Cr2W8V | 415 | 364 | — | 13 |

Note:

The low temperature impact toughness data of Comparative Examples 1-3 at −40° C. are not found, but their toughness at room temperature are lower than that of the materials of the present invention.

TABLE 4

The end quenching hardness of each Example and Comparative Example

| Material | Rockwell hardness HRC (Distance from end quenching surface, mm) | | | | | | | | | |
|---|---|---|---|---|---|---|---|---|---|---|
| | 20 | 40 | 60 | 80 | 100 | 120 | 140 | 160 | 180 | 200 |
| Example 1 | 50.5 | 50.5 | 50.5 | 50 | 50 | 49.5 | 49.5 | 49 | 49 | 48.5 |
| Example 4 | 52 | 52 | 52 | 52 | 51 | 51 | 51 | 50.5 | 50.5 | 49.5 |
| Comparative Example 1 (H13) | 58 | 58 | 58 | 57.5 | 57.5 | 57 | 57 | 57 | 57 | 56.5 |

Note:
With the increase of the distance from the end quenching surface, the hardness of the materials of the invention decreased to a similar degree as that of steel H13.

INDUSTRIAL APPLICABILITY

The materials of the invention are suitable for special working conditions requiring high toughness at low temperatures and high strength at high temperatures and high hardenability, thus have good industrial applicability.

These examples are only preferred examples of the invention, and the scope of the invention is not limited to these examples. Any changes or substitutions that can be easily conceived by those skilled in the art within the technical scope disclosed by the present invention should be covered by the scope of the present invention. Therefore, the scope of the present invention are defined by the claims.

The invention claimed is:

1. A hot-work die steel, wherein the hot-work die steel consists of following components by mass:

C: 0.15-0.16%,
Si: 0.40-0.90%,
Mn: 0.2-0.8%,
Cr: 1.50-2.40%,
Ni: 4.20-4.50%,
Mo: 1.00-1.60%,
V: 0.10-0.40%,
W: 0.20-0.90%,
P: ≤0.02%,
S≤0.02%, and
at least one of Co: 0.10-0.50% and Re: 0.01-0.05%, and
a balance of Fe matrix and other inevitable impurities, and
optionally 0.01-0.03% Zr, or 0.01-0.05 Nb by mass,
wherein the structure of the hot-work die steel is lath martensite/sorbite and does not comprise acicular martensites, and
wherein the hot work die steel has a V notch impact energy of 28 J or more than 28 J at −40° C. according to HB 5278-1984, a high temperature strength of 380 MPa or more at 700° C. according to GB/T4338-2006, and a Rockwell hardness HRC of 48.5-52 according to ASTM A255-02.

2. A method for preparing the hot-work die steel of claim 1, wherein the method comprises:

i) a smelting process;
ii) a homogenizing annealing and forging process;
iii) a post-forging annealing process; and
iv) a quenching and tempering process.

3. The method of claim 2, wherein, in the smelting process, smelting is performed through a process of electric arc furnace smelting, a ladle furnace refining process, a vacuum degassing and an electroslag remelting process.

4. The method of claim 3, wherein, in the smelting process, a rare earth is replenished to maintain its mass content to be more than or equal to 0.01% in the electroslag remelting process.

5. The method of claim 2, wherein, in the homogenizing annealing and forging process, an ingot from step i) is heated to 1200-1250° C. for 5 hours or more, held for 15-25 hours, subsequently cooled down to a heating temperature of 1130-1200° C., and then held for 2-3 hours; in a blooming forging process, an initial forging temperature is 1050-1130° C., a final forging temperature is 850° C. or more, an upsetting and drawing is repeated for 1 to 3 times, and an upsetting ratio is greater than 2.

6. The method of claim 2, wherein, in the homogenizing annealing and forging process, GFM precision forging or other forging means for molding is performed according to the demand; for precision forging, a heating temperature is 900-1050° C., an initial forging temperature is 850-950° C., and a final forging temperature is 800° C. or more; for forging by hydraulic hammer or hydraulic press, a heating temperature is 1150-1200° C., an initial forging temperature is 1130-1160° C., and a final forging temperature is 850° C. or more.

7. The method of claim 2, wherein, in the post-forging annealing process, an obtained forged component from step ii) is transferred to a furnace immediately, and heated to 850-900° C. at a heating rate of 100° C./h or less, held for 6-8 hours, cooled to 500° C. or less in the furnace, removed from the furnace, and cooled in heap to obtain a preform.

8. The method of claim 2, wherein, in the quenching and tempering process, wherein the preform from step iii) is quenched and tempered, the preform is heated to 920-980° C. and held for 1-6 hours, and then cooled to approximately 50-150° C. with water or oil during quenching process, then tempered immediately.

9. The method of claim 8, wherein the tempering process can be carried out twice, wherein a temper temperature is chosen according to the mechanical properties required by the final product, the performance parameters are tested, and a temperature and duration of a second tempering are determined with test results of performance parameters.

* * * * *